United States Patent [19]

Crow

[11] 4,262,761

[45] Apr. 21, 1981

[54] LONG-LIFE MILLED TOOTH CUTTING STRUCTURE

[75] Inventor: Morgan L. Crow, Dallas, Tex.

[73] Assignee: Dresser Industries, Inc., Dallas, Tex.

[21] Appl. No.: 82,386

[22] Filed: Oct. 5, 1979

[51] Int. Cl.[3] ..... E21B 10/52

[52] U.S. Cl. ..... 175/374; 175/410; 76/108 R

[58] Field of Search ..... 175/374, 375, 379, 409, 175/410, 411; 76/108 R

[56] References Cited

U.S. PATENT DOCUMENTS

| | | | |
|---|---|---|---|
| 1,885,085 | 10/1932 | Dalzen | 175/410 X |
| 2,089,481 | 8/1937 | Howard | 76/108 R |
| 2,244,617 | 6/1941 | Hannum | 175/375 X |
| 2,483,221 | 9/1949 | Morrow | 175/410 X |
| 2,644,673 | 7/1953 | Baker | 175/410 X |
| 2,732,198 | 1/1956 | Joy | 175/410 X |
| 3,126,067 | 3/1964 | Schumacher, Jr. | 175/379 X |
| 3,140,748 | 7/1964 | Engle et al. | 175/410 |
| 3,461,983 | 8/1969 | Hudson et al. | 175/375 |

*Primary Examiner*—Ernest R. Purser
*Assistant Examiner*—Richard E. Favreau
*Attorney, Agent, or Firm*—Eddie E. Scott; Fred A. Winans

[57] ABSTRACT

One or more holes are drilled into the crest of the tooth-shaped cutting structure of a milled steel tooth rotary rock bit. Tungsten carbide rods are positioned in the holes and hardfacing is applied to the tooth. The hardfacing is applied across the top of the tooth crest and acts to hold the tungsten carbide rods in place. The rods are inserted in holes parallel and close to one flank of the tooth so that the entire length of the carbide rods can be attached to the hardfacing by burning the hardfacing through to the carbide rods. Wear on the tooth will proceed along the side of the tooth not reinforced with the carbide rods and a self-sharpening effect is enhanced by the strength of the carbide rods. The carbide rods and holes therefore can be relatively inexpensive, since close tolerance finishing is not required.

6 Claims, 5 Drawing Figures

LONG-LIFE MILLED TOOTH CUTTING STRUCTURE

BACKGROUND OF THE INVENTION

The present invention relates in general to the art of earth boring and, more particularly, to an improved cutting structure for a milled tooth rotary rock bit. A type of rotary rock bit used for drilling earth boreholes for the exploration and production of oil and gas and the likes is commonly known as a milled tooth bit. This type of bit employs a multiplicity of rolling cone cutters rotatably mounted on bearing pins extending from the arms of the bit. The cutters are mounted on axes which extend downwardly and inwardly with respect to the bit axis so that the conical sides of the cutters tend to roll on the bottom of the hole and contact the formations. The rolling cone cutters have circumferential rows of teeth to drill the formations at the bottom of the hole. The rows of teeth on each cutter are often located in offset relation to the corresponding rows on the other cutters and drill separate tracks at the bottom of the hole. The teeth tend to wear in a vertical direction and along the ends which engage the peripheral wall of the hole during the drilling operation.

The service life of the tooth cutting structure may be improved by the addition of tungsten carbide particles to certain wear areas of the teeth. This operation is known as "hardfacing". The hardfacing may be designed to create a wear or erosion pattern to produce a self-sharpening tooth profile. The severe use which milled tooth bits encounter results in the components of the bit being repeatedly subjected to much higher stresses with respect to the ultimate strength of the material, than is commonly encountered in other types of machines. In addition, the bits must function profitably in different earth formations. The geometry of the bit must provide a well balanced cutting structure. The efficient use of available space is extremely important. The relationship between the cutters is such that a change in the shape or size of any one cutter affects the other cutters. The determination of cone shape or cone contour is critical.

DESCRIPTION OF THE PRIOR ART

In U.S. Pat. No. 2,244,617 to C. M. Hannum, patented June 3, 1941, a roller bit is shown. Inserts of a relatively hard durable material, such as tungsten carbide or "haystellite" are mounted in the tops of the teeth. The tops of the inserts are substantially coincident with or project a slight amount above the tops of the teeth. These inserts can conveniently be assembled in the teeth by first cutting radial recesses or slots into the tops of the teeth, then inserting "slugs" of the harder metal, in the form of the inserts, into the slots and permanently fixing them therein by a heat treatment bonding. Alternatively, the inserts can be installed in the slots by flowing the harder metal in a molten condition therein, much in the manner of a welding process.

In U.S. Pat. No. 3,126,067 to P. W. Schumacher, Jr., patented Mar. 24, 1964, a roller bit with inserts is shown. The bit includes a head and a plurality of substantially conical roller cutters. Each of the roller cutters has circumferential rows of cutting elements. Each of the rows of cutting elements comprises spaced teeth having circumferentially extending cutting crests. Cylindrical wear-resistant inserts are pressed in sockets in each of the rows between adjacent ends of the cutting crest.

In U.S. Pat. No. 3,260,579 to S. R. Scales and A. E. Wisler, patented July 12, 1966, a hardfacing structure is shown. A cutter for an earth boring bit is shown having a tooth with a crest, a root, flanks and an inner end and an outer end. A layer of tube hardfacing and a superimposed hardfacing layer are applied to the tooth.

In U.S. Pat. No. 3,385,683, to E. B. Williams, Jr., patented May 28, 1968, a method of making and applying an abrasive metal to surfaces is shown. A method is disclosed for producing a hard long-wearing load-bearing surface on a rotary drill bit. Finely-ground tungsten carbide powder is mixed with finely-ground metallic bonding powder for cementing granules of the tungsten particles together. The mixed powders are pressed in cavities having a geometric shape and free of acute angles to form individual masses having the contour of said cavities. The particles are cemented together by heat to produce solid elements of geometric shape and uniform density and hardness without causing the powders to melt and alter the geometric shape. The elements are enclosed in a tubular welding rod. The welding rod is melted to lay down the elements in a uniform layer upon the surfaces of the drill bit with the metal of the tube flowing uniformly around the elements for bonding them together and securing the elements to the surfaces of the drill bit.

In U.S. Pat. No. 3,800,891 to A. D. White and A. E. Wisler, patented Apr. 2, 1974, hardfacing compositions and gage hardfacing on rolling cutter rock bits are shown. The hardfacing compositions are sintered tungsten carbide granules in an alloy steel matrix, the granules consisting of grains of monotungsten carbide cemented together with a number of binders—iron, nickel, alloys of three iron group metals and metallic alloys including at least one iron group metal and at least one metal outside such group. The hardfacings are particularly useful when welded to the gage surfaces of rolling cutters of rock bits, particularly rolling cone cutters made of alloy steel. Part of the matrix comes from the melted surface of the alloy steel cutter and part preferably comes from a hardfacing welding tube containing the granules.

SUMMARY OF THE INVENTION

The present invention provides an improved milled tooth rotary rock bit for drilling earth boreholes. The bit includes a multiplicity of rolling cone cutters with tooth-shaped cutting structure. One or more holes are drilled into the crest of the tooth-shaped cutting structure. Tungsten carbide rods are positioned in the holes and hardfacing is applied to the tooth. The hardfacing is applied across the top of the tooth crest and acts to hold the tungsten carbide rods in place. The rods are inserted in holes parallel and close to one flank of the tooth so that the entire length of the carbide rods can be attached to the hardfacing by burning the hardfacing through to the carbide rods. Wear on the tooth will proceed along the side of the tooth not reinforced with the carbide rods and a self-sharpening effect is enhanced by the strength of the carbide rods. The carbide rods can be relatively inexpensive, since close tolerance finishing is not required. The holes for the rods can be drilled to provide a loose sliding fit for the tungsten carbide rod. Expensive close tolerance holes are not required since there is no pressfit required. The above and other features and advantages of the present invention will become apparent from a consideration of the following detailed description of the invention when taken in conjunction with the accompanying drawings.

DETAILED DESCRIPTION OF THE INVENTION

Figure 1:
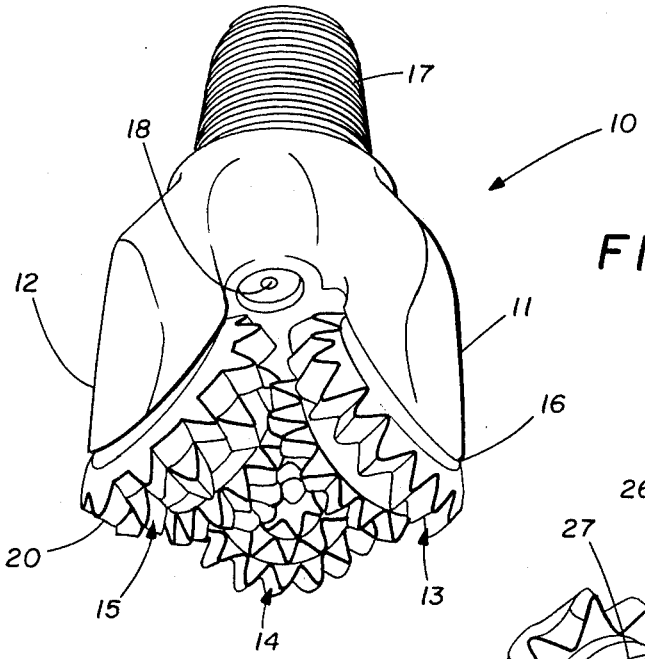
FIG. 1 shows a milled tooth rotary rock bit constructed in accordance with the present invention.

Referring now to the drawings and to FIG. 1 in particular, a milled tooth rotary rock bit generally designated by the reference number 10 constructed in accordance with the present invention is illustrated. The bit 10 includes a bit body adapted to be connected at its upper or pin end 17 to the lower end of a rotary drill string (not shown). The bit body includes a passage providing communication for drilling muds or the like passing downwardly through the drill string to allow the drilling mud to exit through nozzles 18 and be directed to the bottom of the well bore and pass upward in the annulus between the wall of the well bore and the drill pipe carrying cuttings and drilling debris therewith.

Depending from the body of the bit are three substantially identical arms. Arms 11 and 12 are shown in FIG. 1. The lower end portion of each of the arms is provided with a bearing pin. Each arm rotatably supports a generally conical cutter member. The cutter members are designated 13, 14, and 15 in FIG. 1. The bearing pins carrying the cutting members 13, 14, and 15 define axes of rotation respectively about which the cutter members rotate. The axes of rotation are tilted downwardly and inwardly at an angle. A ball plug extends through the arms and bearing pins to allow the balls that make up the ball bearing systems to be introduced into the bearing raceways. The lower end of each arm is designated as the shirttail 16 of the bit 10.

Each of the cutter members 13, 14, and 15 includes a nose portion that is oriented toward the bit axis of rotation and a base 20 that is positioned at the intersection between the wall and bottom of the well bore. The surface of each of the cutter members 13, 14, and 15 includes tooth cutting structure for contacting and disintegrating the formations at the bottom of the borehole. Mud grooves may extend along the base 20 to provide circulation of mud along the borehole wall.

Figure 2:
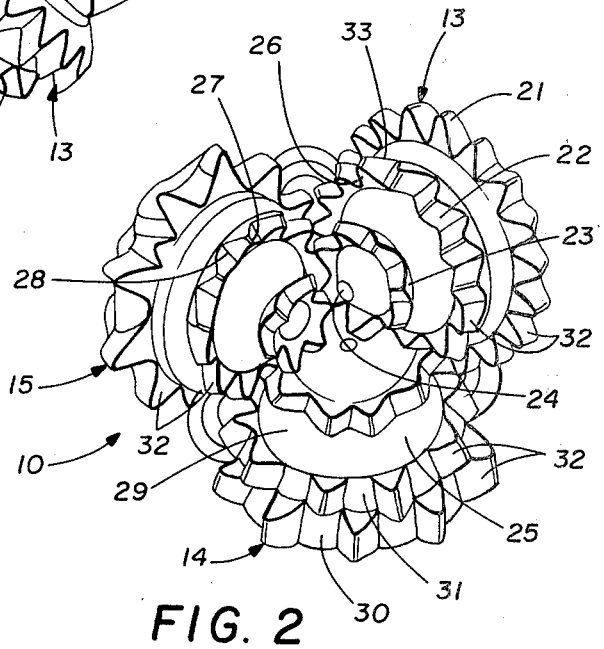
FIG. 2 is a view of the cutting structure of the bit shown in FIG. 1.

Referring now to FIG. 2, a bottom plan view of the bit 10 is shown. The cutters are indicated generally in FIG. 2 by the numerals 13, 14, and 15. The teeth 32 are formed upon the cutters circumferentially thereof in rows along the tapered surface of the cone. For example, see rows 21, 22, and 23 of cone cutter 13. The teeth of one cutter are formed to interfit with the teeth of each of the opposite cutters. The teeth are generally the same gage, and the teeth upon one cutter are formed in rows at slightly a different distance from the nose end 24 than are those on the other, thus allowing the teeth upon one cutter to lie within the trough or groove (see groove 29) formed between the teeth of the opposite cutter.

The teeth 32 are four-sided with oppositely disposed sides in generally convergent relation so that the teeth are of substantially pyramidal shape but with edge-like crests or tops 27. The length of this crest line is shorter than the length of the lines defining the base 28 of the tooth. The crest of the tooth extends from the inner end 26 to the outer end 33 of the tooth. The teeth 32 may in some instances be modified in shape such as the interruption 30 and removal 31.

Figure 3:
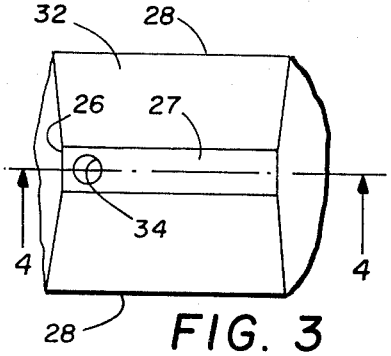
FIG. 3 is a view looking down on a portion of a tooth of the bit shown in FIGS. 1 and 2.
Figure 4:
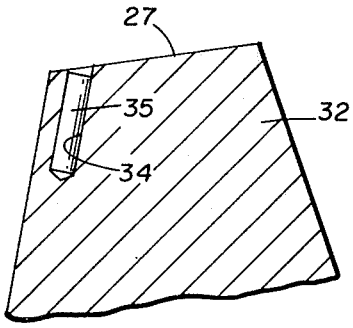
FIG. 4 is a sectional view taken along lines 4—4 of FIG. 3.
Figure 5:
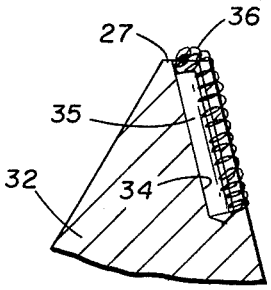
FIG. 5 is a sectional view taken perpendicular to the view of FIG. 4.

Referring now to FIGS. 3, 4, and 5, an individual tooth 32 will be described in greater detail. FIG. 3 is a top view of the tooth 32. FIG. 4 is a sectional view of tooth 32 taken along lines 4—4 and FIG. 5 is a sectional view taken along a line perpendicular to the view of FIG. 4. One or more holes 34 are drilled into the crest 27 of the tooth 32. A tungsten carbide rod 35, which is a loose fit, is dropped into the hole and hardfacing 36 is applied to the tooth. The hardfacing 36 is applied across the top of the tooth crest 27 and holds the tungsten carbide rod 35 in place. The holes 34 drilled into the crest of the steel milled tooth cutting structure can be drilled loose enough to allow a sintered tungsten carbide rod on the order of 1/16-inch diameter by ⅜-inch long to be dropped into the hole. The rod can be used as sintered, since it will be loose fit and no press-fit is required. One or more carbide rods can be inserted along the crest of the tooth. Once the rods are in place, hardfacing is applied across the top of the crest and down one side of the tooth. This hardfacing material may be hardfacing material such as particles of tungsten carbide. The hardfacing material may be applied by welding with a hollow tube containing particles of tungsten carbide material. The rods are inserted in holes parallel and close to one flank of the tooth so that the entire length of the carbide rod is attached to the hardfacing by burning the hardfacing through to the carbide rod. Wear on the tooth will then proceed along the side of the tooth not reinforced with the carbide rods so that a self-sharpening effect will be enhanced by the strength of the carbide rods. The carbide rods are inexpensive, since close tolerance finishing is not required.

The present invention provides an improved milled tooth rotary rock bit for drilling earth boreholes. The present invention will attain a longer life cutting structure for milled steel tooth bits with only a modest increase in cost. One or more holes are drilled into the crest of the tooth-shaped cutting structure. Tungsten carbide rods are positioned in the holes and hardfacing is applied to the tooth. The hardfacing is applied across the top of the tooth crest and acts to hold the tungsten carbide rods in place. The rods are inserted in holes parallel and close to one flank of the tooth so that the entire length of the carbide rods can be attached to the hardfacing by burning the hardfacing through to the carbide rods. Wear on the tooth will proceed along the side of the tooth not reinforced with the carbide rods and a self-sharpening effect is enhanced by the strength of the carbide rods. The carbide rods can be relatively inexpensive, since close tolerance finishing is not required. The holes for the tungsten carbide rods are drilled to commercial drilling tolerances since no press-fit is required. The tungsten carbide rods are held in place by the hardfacing welded to the rods and the supporting tooth for substantially all of the length to the tungsten carbide rods.

The embodiments of the invention in which an exclusive property or privilege is claimed are defined as follows:

1. A method of manufacturing an earth boring cutter having at least one tooth with a crest formed by outwardly converging flanks, comprising the steps of:

drilling a hole into the tooth from the crest of the tooth and generally adjacent one of said flanks;

positioning a tungsten carbide rod in said hole; and applying hardfacing to the tooth crest across said hole and along said one of said flanks for penetrating therethrough to hold the tungsten carbide rod in place.

2. A method of manufacturing a milled tooth cutter rotary rock bit, said bit having at least one tooth with a crest and a side flank, comprising the steps of:

drilling one or more holes into the tooth from the crest of the tooth and generally adjacent said flank;

positioning a tungsten carbide rod in said hole; and applying hardfacing across the tooth crest and along said flank to hold the tungsten carbide rod in place.

3. A method of manufacturing an earth boring cutter having a tooth with a crest and a first and second flank, comprising the steps of:

drilling one or more holes into the tooth from the crest of the tooth and close to and parallel to said second flank;

positioning a tungsten carbide rod, which is a loose fit, in the hole;

applying hardfacing across the top of the tooth crest to hold the tungsten carbide rod in place;

applying hardfacing along said second flank penetrating and joining said tungsten carbide rod.

4. An improved milled tooth rotary rock bit having at least one rolling cutter member for forming a borehole in the earth, said rolling cutter member having at least one annular row of teeth extending from the cutter member for cutting portions of the borehole, said teeth having outwardly converging side flanks terminating in a formation contacting crest, said improvement comprising:

said crests having one or more holes therein extending closely adjacent one of said flanks; and a tungsten carbide rod, which is a loose fit, positioned in the hole and hardfacing applied across the hole and to said one flank to hold the tungsten carbide rod in place.

5. Structure according to claim 4 wherein said hole penetrates said tooth from said crest and generally parallel said one flask and wherein said hardfacing is applied to said flank throughout the length of said rod and penetrates said flank to join said rod to said tooth.

6. Structure according to claim 5 wherein said hardfacing is applied across the tooth crest.

* * * * *